US007237479B2

(12) United States Patent
Pollien

(10) Patent No.: US 7,237,479 B2
(45) Date of Patent: Jul. 3, 2007

(54) DEVICE FOR SUCCESSIVELY TRANSPORTING SHEETS IN A PLATEN PRESS

(75) Inventor: Jean-Francois Pollien, Penthaz (CH)

(73) Assignee: Bobst S.A. (CH)

( * ) Notice: Subject to any disclaimer, the term of this patent is extended or adjusted under 35 U.S.C. 154(b) by 238 days.

(21) Appl. No.: 11/116,513

(22) Filed: Apr. 28, 2005

(65) Prior Publication Data

US 2005/0248084 A1 Nov. 10, 2005

(30) Foreign Application Priority Data

May 5, 2004 (CH) ..... 799/04

(51) Int. Cl.
*B30B 5/04* (2006.01)

(52) U.S. Cl. ..... 100/151; 100/306; 100/311; 72/405.02; 72/405.09

(58) Field of Classification Search ..... 100/311, 100/312, 306, 307, 151, 152; 72/405.02, 72/405.09, 405.1, 422
See application file for complete search history.

(56) References Cited

U.S. PATENT DOCUMENTS 2,258,880 A 10/1941 Bobst ..... 164/87
4,420,359 A * 12/1983 Goldsworthy ..... 156/379.8
4,520,645 A * 6/1985 Ross et al. ..... 72/250
5,275,096 A * 1/1994 Dahlgren et al. ..... 100/303
5,680,787 A * 10/1997 Fisch ..... 72/405.16
6,418,611 B1 * 7/2002 Weber et al. ..... 29/564.6

OTHER PUBLICATIONS

European Search Report EP 04 40 5281 dated Sep. 27, 2004.

* cited by examiner

*Primary Examiner*—Joe Dillon, Jr.
(74) *Attorney, Agent, or Firm*—Ostrolenk, Faber, Gerb & Soffen, LLP

(57) ABSTRACT

A device for successively transporting sheets in a platen press includes gripper bars with respective ends fixedly attached to two flexible of endless loop elements. Each loop element is engaged respectively with an intermittent drive wheel and at least one free wheel. A rectangular working chase and a movable platen arranged on both sides of the path of the grippers of the said bar. Nozzles are connected to a compressed air supply, for directing air jets towards the movable platen during a stopping phase of the gripper bars, in order to successively stop the sheets between the working chase and the movable platen. The nozzles are located below the transverse rear edge of the working chase.

4 Claims, 5 Drawing Sheets

DEVICE FOR SUCCESSIVELY TRANSPORTING SHEETS IN A PLATEN PRESS

BACKGROUND OF THE INVENTION

The present invention refers to a device for successively transporting sheets in a platen press. It comprises gripper bars, having respective ends which are fixedly attached to two flexible elements in the shape of endless loops. Each loop is engaged respectively with an intermittent drive wheel and at least one free wheel. A rectangular working chase and a movable platen are arranged on both sides of the path of the grippers of the bar. Nozzles connected to a compressed air supply direct air jets towards the movable platen during the stopping phase of the gripper bar, in order to successively stop the sheets between the working chase and the movable platen.

To transport a sheet, the gripper bar seizes it at the front edge and brings it between the working chase and the cutting plate fixed on the movable platen of the platen press. At the end of the path, the gripper bar strongly decelerates before stopping and is raised as soon as it comes out from the transverse rear edge of the working chase.

During this abrupt deceleration of the gripper bar, it is important to prevent deformation of the sheet and to force the sheet to remain practically flat. When a flexible sheet thus transported undergoes a strong deceleration, it primarily deforms downwards due to the force of gravity exerted on it. That is the reason why the grippers of the gripper bar are preferably located at the level of the lower face of the profile forming the gripper bar, so that the sheet travels as near as possible to the movable platen.

To avoid upward deformation of the decelerated sheet, it has already been proposed to form a flow of compressed air between the sheet and the board fixed inside the working chase of the platen press. However, in solutions suggested up to now, the nozzles that blow compressed air are arranged behind the transverse rear edge of the working chase, so that the air flow is interrupted before the grippers fully stop. Consequently a relatively large space still separates the platen from the working chase. Therefore, the air blower stops before the sheet and the space which remains at this moment between the working chase and the movable platen does not exclude further deformation of the sheet under the effect of the strong deceleration.

SUMMARY OF THE INVENTION

The object of the present invention is to at least partly obviate the above drawbacks which force a deceleration of the working speeds in order to avoid pleating of the sheets.

To this aim, the object of the present invention is to provide a device for successively transporting sheets in a platen press, which includes gripper bars with respective ends fixedly attached to two flexible endless loop elements. Each loop element is engaged respectively with an intermittent drive wheel and at least one free wheel. A rectangular working chase and a movable platen are respectively arranged above and below the path of the grippers of the gripper bar. Nozzles are connected to a compressed air supply for directing air jets towards the movable platen during a stopping phase of the gripper bar, in order to successively stop the sheets between the working chase and the movable platen. The nozzles are located below the transverse rear edge of the working chase.

Due to the position of the nozzles, the air flow is efficient practically until the sheet stops. Therefore, the sheet remains practically flat and is thus stopped with greater safety. This allows increasing the working speeds of the platen press without increasing the risks of defects or of jamming of the machine. As will be noted from the following description, the proposed solution is particularly simple as regards both the manufacture and the use of the device.

Other features and advantages of the present invention will be clear from the following description made with the help of the enclosed drawings which illustrate, schematically and by way of example, an embodiment of the transporting device of the present invention.

BRIEF DESCRIPTION OF THE DRAWING(S)

DETAILED DESCRIPTION OF EMBODIMENTS OF THE INVENTION

Figure 1:
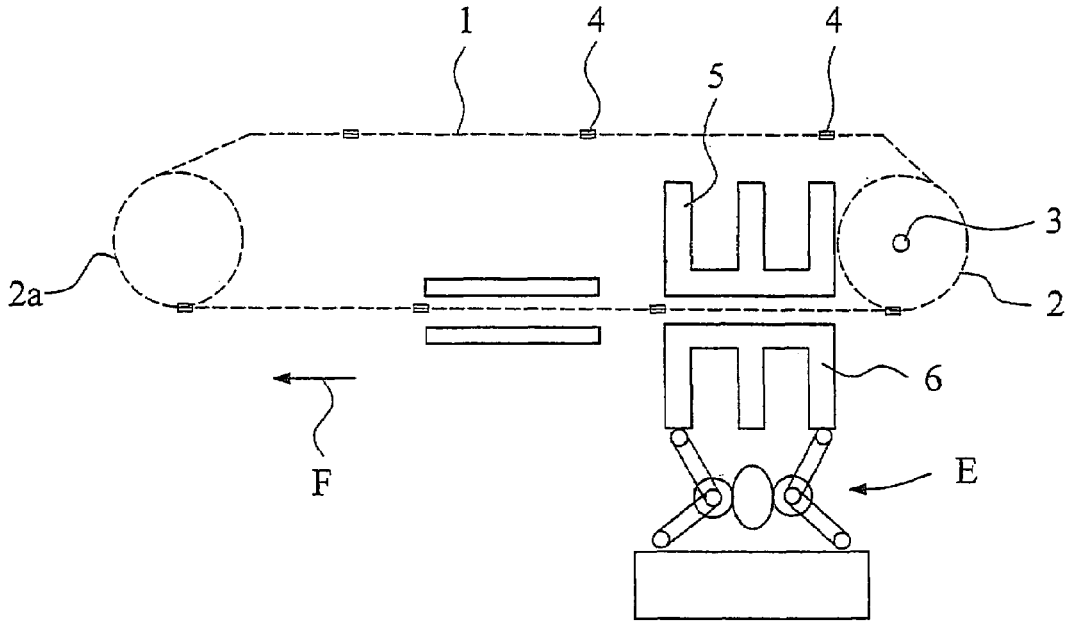
FIG. 1 is a very schematic front view of the platen press and its transporting device.

Two flexible elements in the shape of endless loops, preferably comprised of two parallel, laterally spaced apart, endless gripper bar chains of the platen press. Only one loop is visible in FIG. 1. The loops are driven in the direction of arrow F by two drive sprocket wheels, of which only one wheel 2 is visible in FIG. 1. These wheels are fixedly attached to a same drive shaft 3. Since the intermittent drive mechanism is well known to the skilled man and is also not necessary for the understanding of the present invention, it is neither be illustrated nor described. Both gripper bar chains 1 travel around a second free wheel 2*a* to form an endless loop.

Gripper bars 4 are fixed at their respective lateral ends to two parallel gripper bar chains 1 and extend transversely to the travel direction F of the gripper bar chains 1. Their path passes between a working chase 5 arranged above the path of the gripper bars 4 and a movable platen 6 arranged below this path. The movable platen 6 is associated with guide means along a vertical path and is actuated along the guiding means (not shown) by a drive mechanism E with vertical alternating countermovement, illustrated very schematically since it is not part of the present invention, which alternately brings the platen 6 closer to and moves it away from the working chase 5.

In the illustrated example, the platen press is used for diecutting sheets 7 brought between the working chase 5 and the movable platen 6. That working chase 5 carries a board 8 provided with grooves, formed according to the cutting dies to be applied to the sheets and the grooves receive the cutting plates 9 carried by the movable platen 6.

Figure 2:
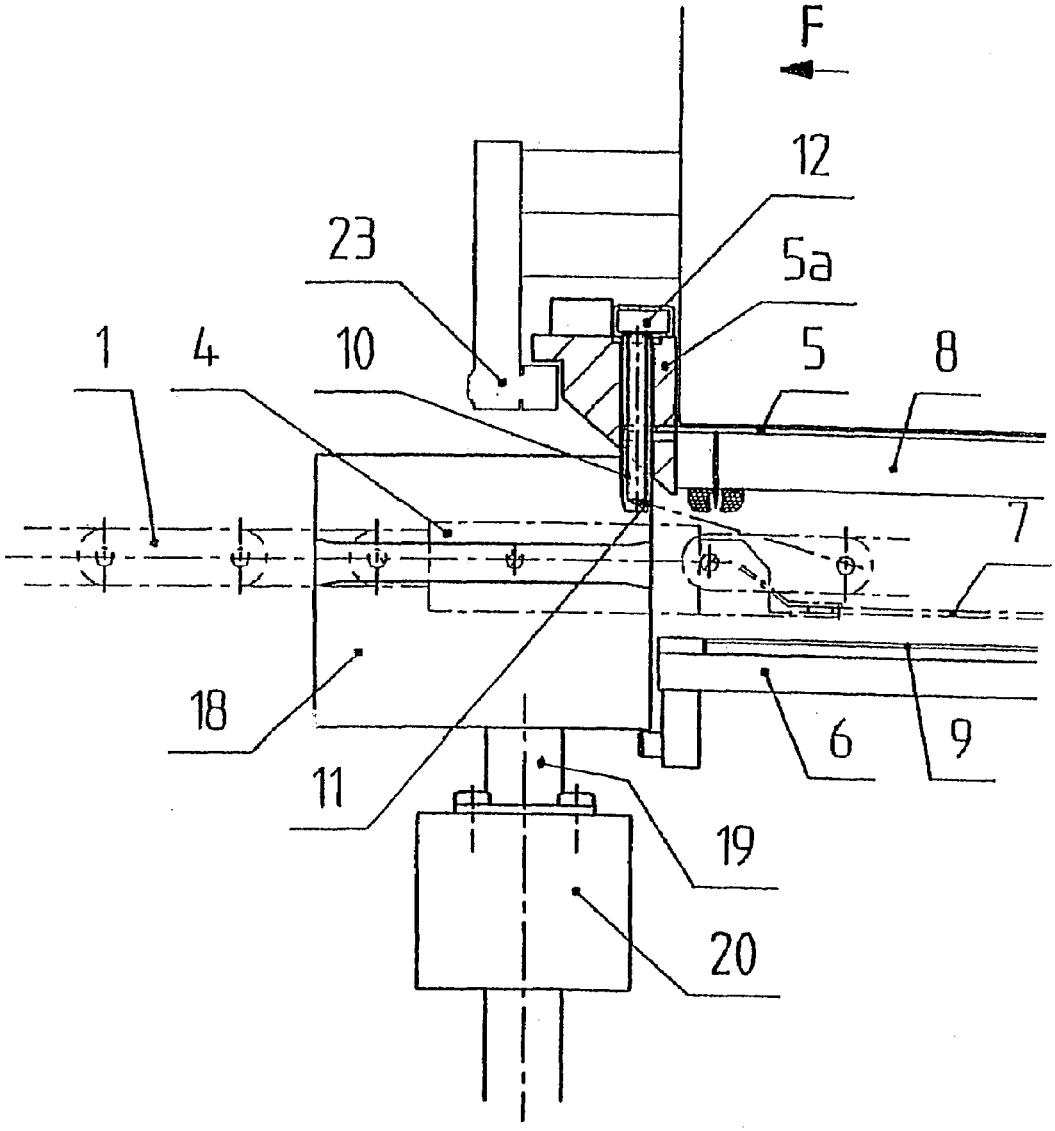
FIG. 2 is a partial front view of the rear part of the working chase of the platen press with the gripper bar in a first position.
Figure 3:
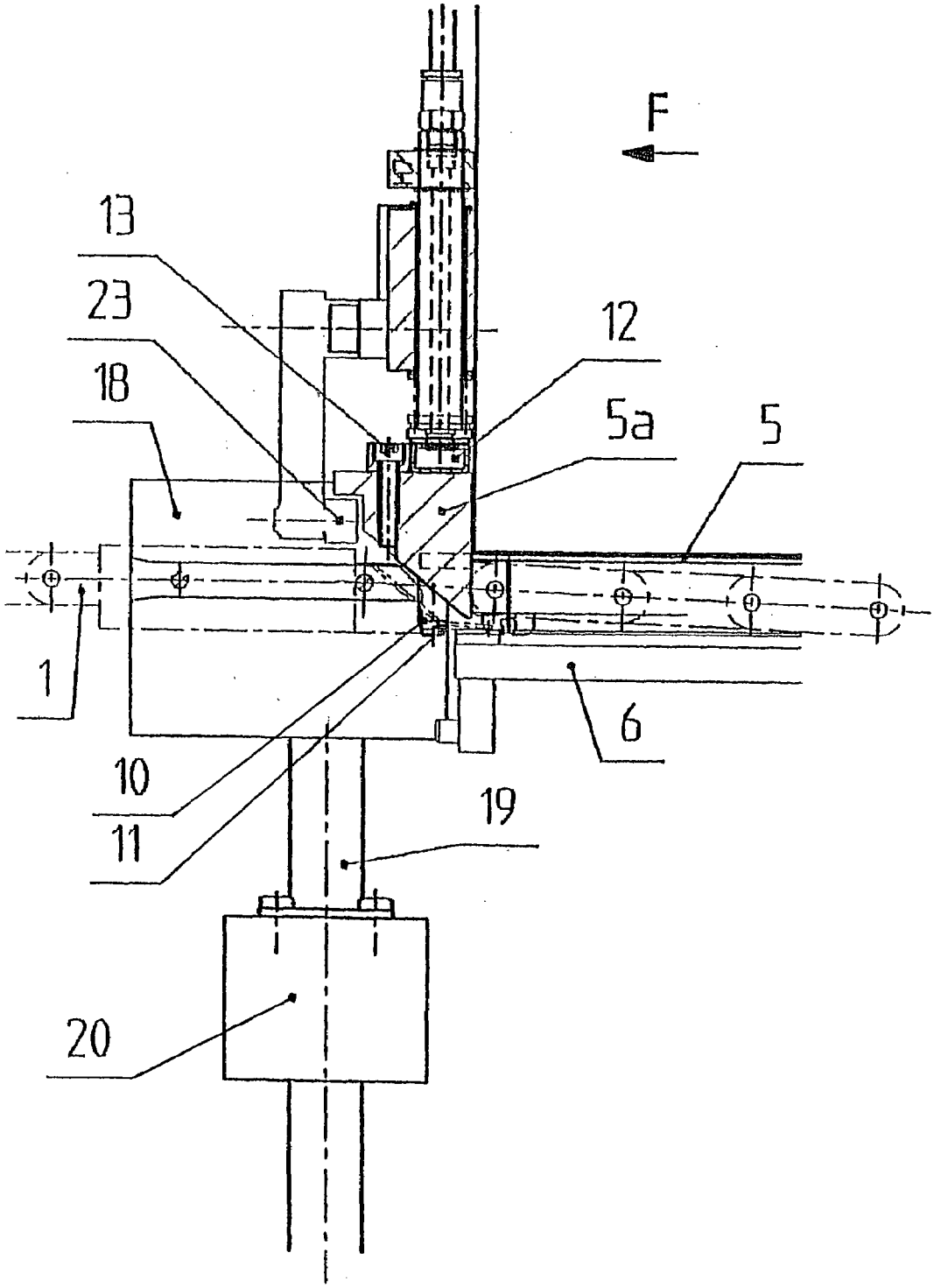
FIG. 3 is a view similar to FIG. 2 with the gripper bar in another position.
Figure 4:
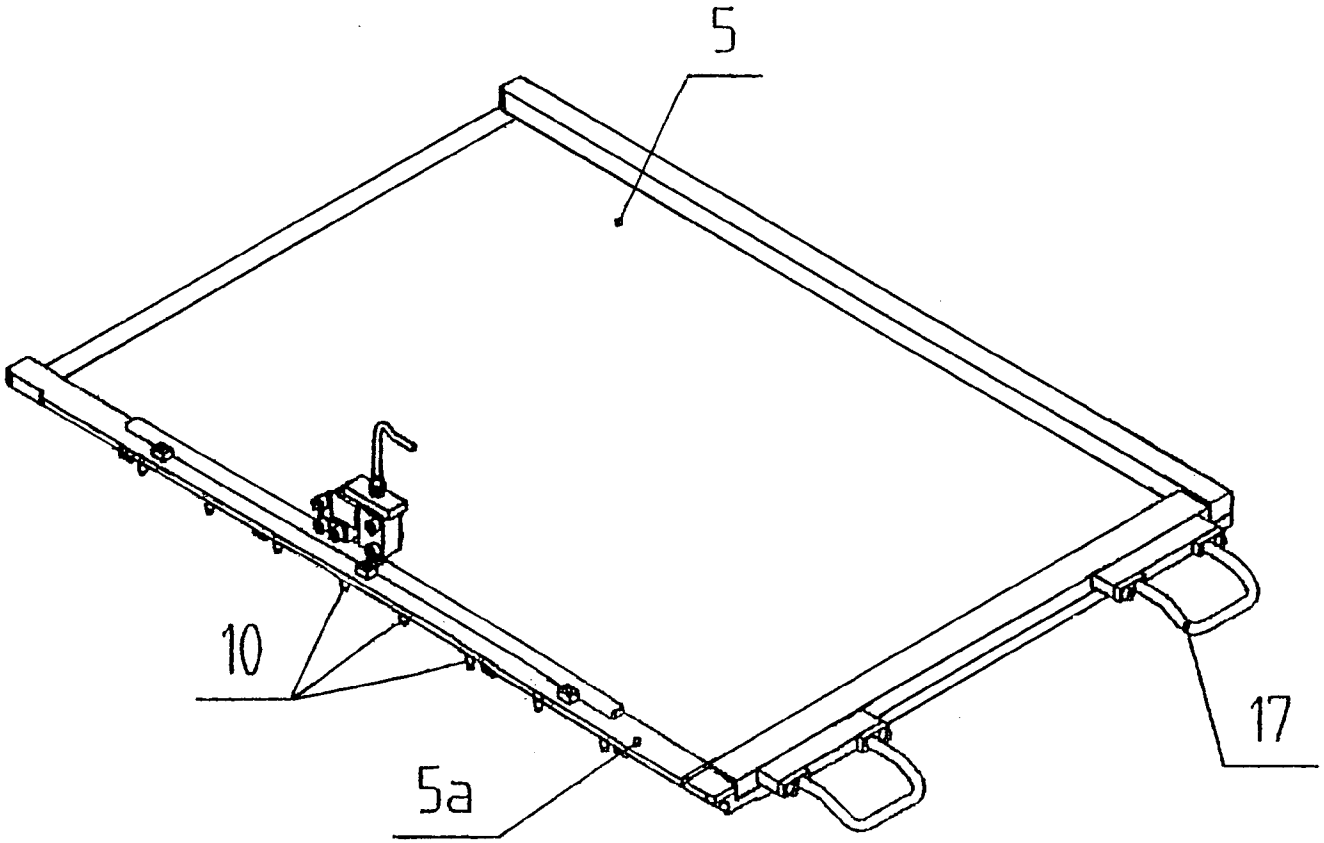
FIG. 4 is a perspective view of the working chase partially illustrated in FIGS. 2 and 3.
Figure 6:
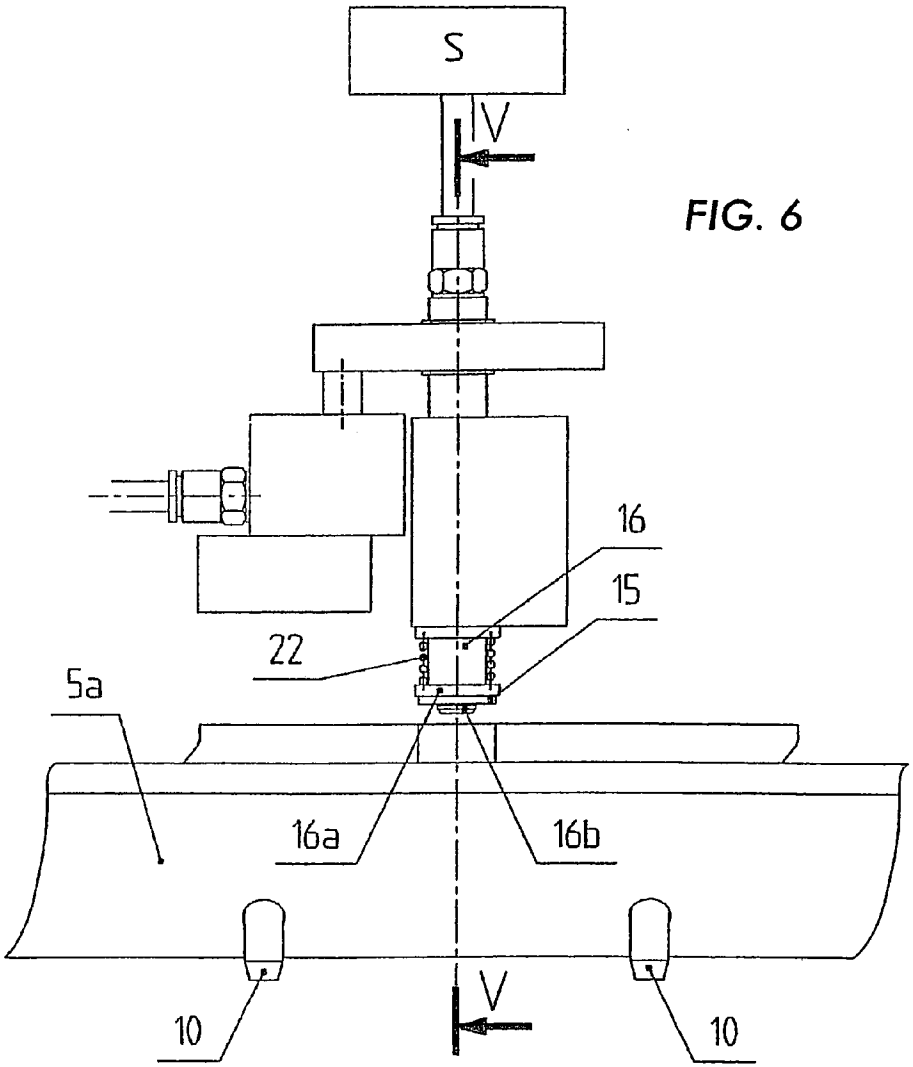
FIG. 6 is a partial front view according to VI-VI of FIG. 5.
Figure 5:
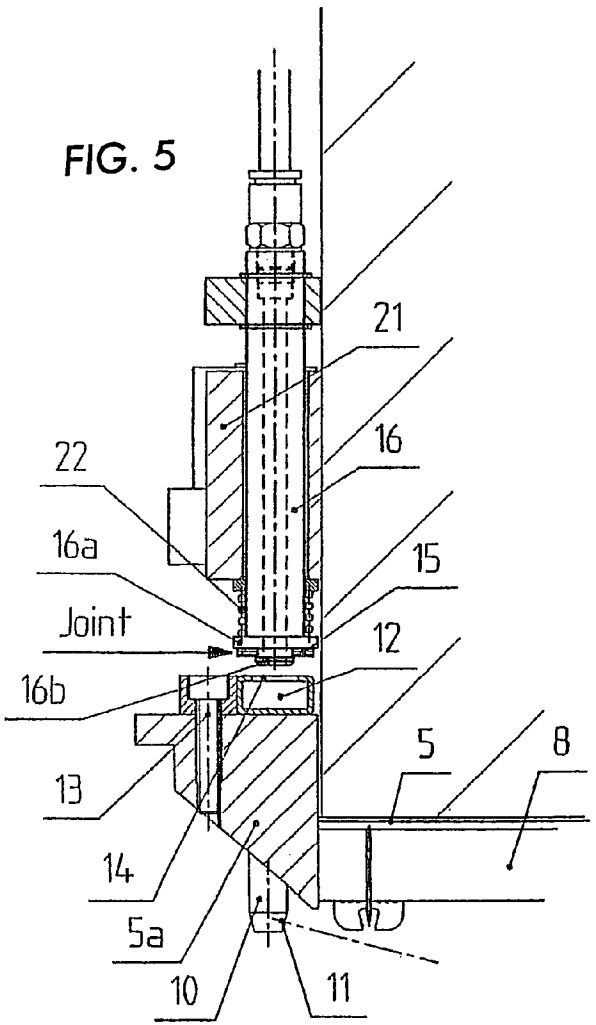
FIG. 5 is a partial sectional view according to V-V of FIG. 6 showing a detail of the sealing of the compressed air supply circuit.

The transverse rear edge 5*a* of the working chase 5, sectionally illustrated in FIGS. 2 and 3 as well as perspectively in FIG. 4, is crossed by a plurality of vertical tubular ducts 10 regularly distributed along the rear edge 5*a* and positioned so as to pass between the grippers 4*a* of the gripper bar 4. The lower end of these tubular ducts 10 is closed. A laterally directed nozzle 11 opens in immediate proximity of this closed end to form a jet in the direction of the movable platen 6, so that this jet will be directed against the sheet 7 at the time of the braking of the gripper bar 4, in order to maintain the sheet flat in opposition to the decelerating force which is exerted thereon and tends to undulate the sheet. The other end of the tubular ducts 10 opens in a distribution channel 12, advantageously of rectangular section, fixed by screws 13 on the upper face of the transverse bar 5*a* of the working chase 5. The upper face of this rectangular distribution channel 12 comprises in its middle a connection opening 14, adapted to engage with a vertical supply duct 16 equipped with a seal 15, connected to a compressed air source S. The vertical supply duct 16 is slidably mounted in a support 21 fixedly attached to the frame of the press. A spring 22 surrounds the supply duct 16 and rests on the one hand against the lower face of the support 21 and on the other hand against a bearing 16*a* provided at the lower end of the supply duct 16. As soon as the supply duct is subjected to the force of the spring 22, its lower end 16*a* is applied against the connection opening 14 of the distribution channel 12 and the seal 15 is compressed by the spring 22 against the upper face of the distribution channel 12.

The working chase 5 is a removable element slidably mounted on a transverse sliding rail 23 of the platen press and the chase comprises to this end handles 17 fixedly attached to the lateral edge 5*b* of the chase 5, allowing its positioning and removal. When positioning the chase, the connection opening 14 is arranged facing the end of the supply duct 16 of the platen press allowing the connection and thus the supply of the nozzles 11. The distribution of compressed air to these nozzles is realized by the control of the machine and occurs at the time of braking of the gripper bar chains 1.

A movable chain guide 18, fixedly attached to the rod 19 crossing a guide 20, is arranged just downstream from the platen press outlet. FIG. 2 shows the chain guide 18 in low position and FIG. 3 shows it in raised position.

FIGS. 2 and 3 illustrate the gripper bar 4 in two different positions of the supply process of a sheet 7 between the working chase 5 carrying the cutting board 8 and the movable platen 6 carrying the cutting plate 9. FIG. 2 corresponds to the braking of the gripper bar 4, wherein the movable platen 6 is spaced apart from the working chase 5. As can be observed in this Figure, the grippers 4*a* of the gripper bar 4 are located at the lower level of the profile forming the gripper bar 4 so that the sheet 7 is moved very close to the surface of the movable platen 6 because of the aforesaid reasons. As can be seen in FIG. 2, the compressed air jets of the nozzles 11 are not impeded, so that the sheet 7 is subjected to the pressure of this air during the braking of the gripper bar 4 and thus the sheet remains flat.

When the gripper bar 4 arrives towards the transverse rear edge 5*a* of the chase 5, the rod 19 of the cylinder 20 pushes the movable chain guide 18 upwards, into the position shown by FIG. 3. At the same time the gripper bar 4 stops. Simultaneously, the platen 6 is moved towards the chase 5 for diecutting the sheet 7. As can be noted in FIGS. 2 and 3, the nozzles 11 can blow onto the sheet 7 until the gripper bar stops and thus ensures that the sheet 7 remains flat.

For changing the working chase 5, it is sufficient to separate the vertical supply duct 16 from the distribution channel 12 by sliding the supply duct 16 upwards, in opposition to the pressure of the pull-back spring 22 and to draw the working chase by means of the handles 17. After the positioning of another working chase 5, releasing the supply duct 16 enables the pull-back spring 22 to apply the end of this duct 16 against the connection opening 14 of the distribution channel 22 and to compress the seal 15 between the annular bearing 16*a* of the duct 16 and the edge of the connection opening 14. Therefore, this is an operation which does not present any difficulty and which does not require any particular skill.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Device for successively transporting sheets in a platen press comprising:

a flexible element in the shape of an endless loop; the flexible element engages an intermittent drive wheel and at least one free guide wheel;

gripper bars having a respective end fixedly attached to the flexible element, the gripper bars including grippers thereon;

a working chase and an opposed movable platen respectively above and below the path of the grippers of the gripper bar;

nozzles connected to a compressed air supply, for directing air jets towards the movable platen during a stopping phase of the gripper bars, in order to successively stop the sheets between the working chase and the movable platen, the chase having a transverse rear edge, and the nozzles being arranged below the transverse rear edge of the said working chase.

2. The device according to claim 1, further comprising a plurality of vertical ducts crossing the transverse rear edge of the working chase, the ducts having lower closed ends which are at and comprise at least one of the nozzles which extends laterally, the ducts being transversely distributed between the grippers of the gripper bar.

3. The device according to claim 2, wherein the vertical ducts have upper ends; a distribution channel arranged on the transverse rear edge of the working chase and to which the vertical ducts are fixedly attached for connecting the vertical ducts to the compressed air supply.

4. The device according to claim 3, wherein the distribution channel has an upper face, a connection opening crossing the upper face;

a vertical supply duct connected to and being slidably mounted with respect to the working chase and in opposition to the pressure of a pull-back spring pressing the duct towards the said distribution channel;

the supply duct having a lower end, and a seal arranged between the lower end of the supply duct and the connection opening.

* * * * *